US009197019B2

(12) United States Patent
Green et al.

(10) Patent No.: US 9,197,019 B2
(45) Date of Patent: Nov. 24, 2015

(54) GROUNDING CLIP FOR ELECTRICAL COMPONENTS

(71) Applicant: Hubbell Incorporated, Shelton, CT (US)

(72) Inventors: Richard Michael Green, Herndon, VA (US); Stephen Kent Lebo, Falls Church, VA (US); Bruce Michael Lipski, Leesburg, VA (US)

(73) Assignee: Hubbell Incorporated, Shelton, CT (US)

( * ) Notice: Subject to any disclaimer, the term of this patent is extended or adjusted under 35 U.S.C. 154(b) by 70 days.

(21) Appl. No.: 14/209,074

(22) Filed: Mar. 13, 2014

(65) Prior Publication Data

US 2014/0273547 A1 Sep. 18, 2014

Related U.S. Application Data

(60) Provisional application No. 61/781,695, filed on Mar. 14, 2013.

(51) Int. Cl.
*H01R 13/648* (2006.01)
*H01R 13/655* (2006.01)
*H01R 13/6594* (2011.01)

(52) U.S. Cl.
CPC ..... *H01R 13/655* (2013.01); *H01R 13/6485* (2013.01); *H01R 13/6594* (2013.01); *Y10T 29/49117* (2015.01)

(58) Field of Classification Search
CPC ..... H01R 13/65802; H01R 23/6873
USPC ..... 439/607.28, 607.05, 108, 939, 95
See application file for complete search history.

(56) References Cited

U.S. PATENT DOCUMENTS

| | | | | |
|---|---|---|---|---|
| 4,883,433 | A | 11/1989 | Lane | |
| 5,908,331 | A * | 6/1999 | Hsu et al. | 439/607.28 |
| 6,111,746 | A | 8/2000 | Wahl et al. | |
| 6,155,878 | A | 12/2000 | Chen | |
| 6,343,956 | B2 | 2/2002 | Stickney | |
| 6,450,837 | B1 | 9/2002 | Givens et al. | |
| 6,659,655 | B2 * | 12/2003 | Dair et al. | 385/92 |
| 6,986,679 | B1 | 1/2006 | Aronson et al. | |
| 7,044,791 | B2 | 5/2006 | Wang | |
| 7,170,169 | B2 | 1/2007 | Trout et al. | |
| 7,175,444 | B2 * | 2/2007 | Lang et al. | 439/76.1 |
| 7,351,090 | B1 | 4/2008 | Moore | |

(Continued)

FOREIGN PATENT DOCUMENTS

GB 2 213 328 A 3/1987

*Primary Examiner* — Abdullah Riyami
*Assistant Examiner* — Thang Nguyen
(74) *Attorney, Agent, or Firm* — Dickinson Wright PLLC

(57) ABSTRACT

Grounding clips for electrical components are disclosed to eliminate or significantly reduce ESD and EMI. A grounding clip includes a first leg oppositely disposed with respect to a second leg and connected to the second leg by a third leg, mounting tabs for connecting the first and second legs to a PCB, a resilient upper flange formed in the third leg and angled with respect to the third leg inwardly toward the first mounting tab and the second mounting tab (e.g., for compression fit with respect to an SFP mounting cage), resilient flanges formed in the first and second legs and angled to extend inwardly toward one another. A hook member extends outwardly from an edge of the first leg to form an electromagnetic gasket with respect to a front panel and grounding clip.

20 Claims, 9 Drawing Sheets

(56) References Cited

U.S. PATENT DOCUMENTS

| | | | | |
|---|---|---|---|---|
| 7,557,306 | B2 | 7/2009 | Chen et al. | |
| 7,901,221 | B1 | 3/2011 | Li et al. | |
| 7,928,324 | B2 | 4/2011 | Moore | |
| 2002/0072274 | A1* | 6/2002 | Flickinger et al. | 439/607 |
| 2005/0254257 | A1* | 11/2005 | Long | 362/581 |
| 2006/0014431 | A1* | 1/2006 | Shuey et al. | 439/607 |
| 2008/0299813 | A1* | 12/2008 | Dawiedczyk et al. | 439/357 |
| 2009/0233484 | A1* | 9/2009 | Wu et al. | 439/607.05 |
| 2010/0035465 | A1* | 2/2010 | Wang | 439/541.5 |
| 2011/0294347 | A1* | 12/2011 | Lang et al. | 439/607.01 |

* cited by examiner

GROUNDING CLIP FOR ELECTRICAL COMPONENTS

This application claims the benefit of U.S. Provisional Application Ser. No. 61/781,695, filed Mar. 14, 2013, the entire content of which is incorporated herein by reference.

FIELD OF THE INVENTION

The present invention relates generally to a grounding clip for electrical components. More particularly, the present invention relates to a grounding clip connected with respect to an electrical component and a printed circuit board. Still more particularly, the present invention relates to a grounding clip for an electrical component that substantially prevents electrostatic discharge and substantially reduces electromagnetic interference emissions.

BACKGROUND OF THE INVENTION

Multiservice access switches provide Ethernet access services and generally include a plurality of cards mounted in a chassis. The cards include electrical components mounted thereon to facilitate providing the Ethernet access services.

One problem associated with multiservice access switches is electrostatic discharge (ESD). This problem is heightened where the electronic components are connected to conductive equipment services. The static discharge can damage the electrical components and other components electrically connected thereto. Accordingly, a need exists for electrical components in which electrostatic discharge is substantially prevented.

Another problem associate with multiservice access switches is electromagnetic interference (EMI). Electrical circuits can be a source of EMI, which can interrupt, obstruct or otherwise degrade or limit the effective performance of the electrical circuit. Accordingly, a need exists for electrical components in which electromagnetic interference is substantially reduced.

SUMMARY OF THE INVENTION

An object of the present invention is to provide an improved grounding clip for electrical components.

Another object of the present invention is to provide a grounding clip for an electrical component that substantially prevents electrostatic discharge.

Still another objective of the present invention is to provide a grounding clip for an electrical component that substantially reduces electromagnetic interference.

Other objects, advantages and salient features of the invention will become apparent from the following detailed description, which, taken in conjunction with the annexed drawings, discloses a preferred embodiment of the invention.

These and other objects are substantially achieved by providing an illustrative grounding clip including a first leg oppositely disposed with respect to a second leg and connected to the second leg by a third leg, at least one first mounting tab connected to an end of the first leg, at least one second mounting tab connected to an end of the second leg, a resilient upper flange formed in the third leg and angled with respect to the third leg inwardly toward the at least one first mounting tab and the at least one second mounting tab, a resilient first side flange formed in the first leg and angled with respect to the first leg, a resilient second side flange formed in the second leg and angled with respect to the second leg, wherein the first side flange and the second side flange extend inwardly toward one another, and at least one hook member extending outwardly from an edge of the first leg.

These and other objects are substantially achieved by providing an illustrative printed circuit in combination with a grounding clip. The grounding clip includes a first leg oppositely disposed with respect to a second leg and connected to the second leg by a third leg, at least one first mounting tab connected to an end of the first leg, at least one second mounting tab connected to an end of the second leg, a resilient upper flange formed in the third leg and angled with respect to the third leg inwardly toward the at least one first mounting tab and the at least one second mounting tab, a resilient first side flange formed in the first leg and angled with respect to the first leg, a resilient second side flange formed in the second leg and angled with respect to the second leg, wherein the first side flange and the second side flange extend inwardly toward one another, and at least one hook member extending outwardly from an edge of the first leg. The printed circuit includes a mounting cage. The grounding clip is disposed over the mounting cage.

These and other objects are substantially achieved by providing an illustrative method of avoiding electronic circuit damage to an electrical component. The method includes providing a printed circuit comprising a mounting cage adapted to receive the electrical component. The method further includes providing a grounding clip including a first leg oppositely disposed with respect to a second leg and connected to the second leg by a third leg, at least one first mounting tab connected to an end of the first leg, at least one second mounting tab connected to an end of the second leg, a resilient upper flange formed in the third leg and angled with respect to the third leg inwardly toward the at least one first mounting tab and the at least one second mounting tab, a resilient first side flange formed in the first leg and angled with respect to the first leg, a resilient second side flange formed in the second leg and angled with respect to the second leg, wherein the first side flange and the second side flange extend inwardly toward one another, and at least one hook member extending outwardly from an edge of the first leg. The method further comprises disposing the grounding clip over the mounting cage.

As used in this application, the terms "front," "rear," "upper," "lower," "upwardly," "downwardly," and other orientational descriptors are intended to facilitate the description of the exemplary embodiment of the present invention, and are not intended to limit the structure of the exemplary embodiment of the present invention to any particular position or orientation.

BRIEF DESCRIPTION OF THE DRAWINGS

The above aspects and features of the present invention will be more apparent from the description for exemplary embodiments of the present invention taken with reference to the accompanying drawings, in which.

Throughout the drawings, like reference numerals will be understood to refer to like parts, components and structures.

DETAILED DESCRIPTION OF EXEMPLARY EMBODIMENTS

As shown in FIGS. 1-18, a grounding clip in accordance with an exemplary embodiment of the present invention substantially prevents electrostatic discharge and substantially reduces electromagnetic interference. Although the exemplary embodiments of the present invention are described with regard to a mounting cage of an SFP transceiver module, the present invention is equally applicable to other electrical components.

Figure 1:
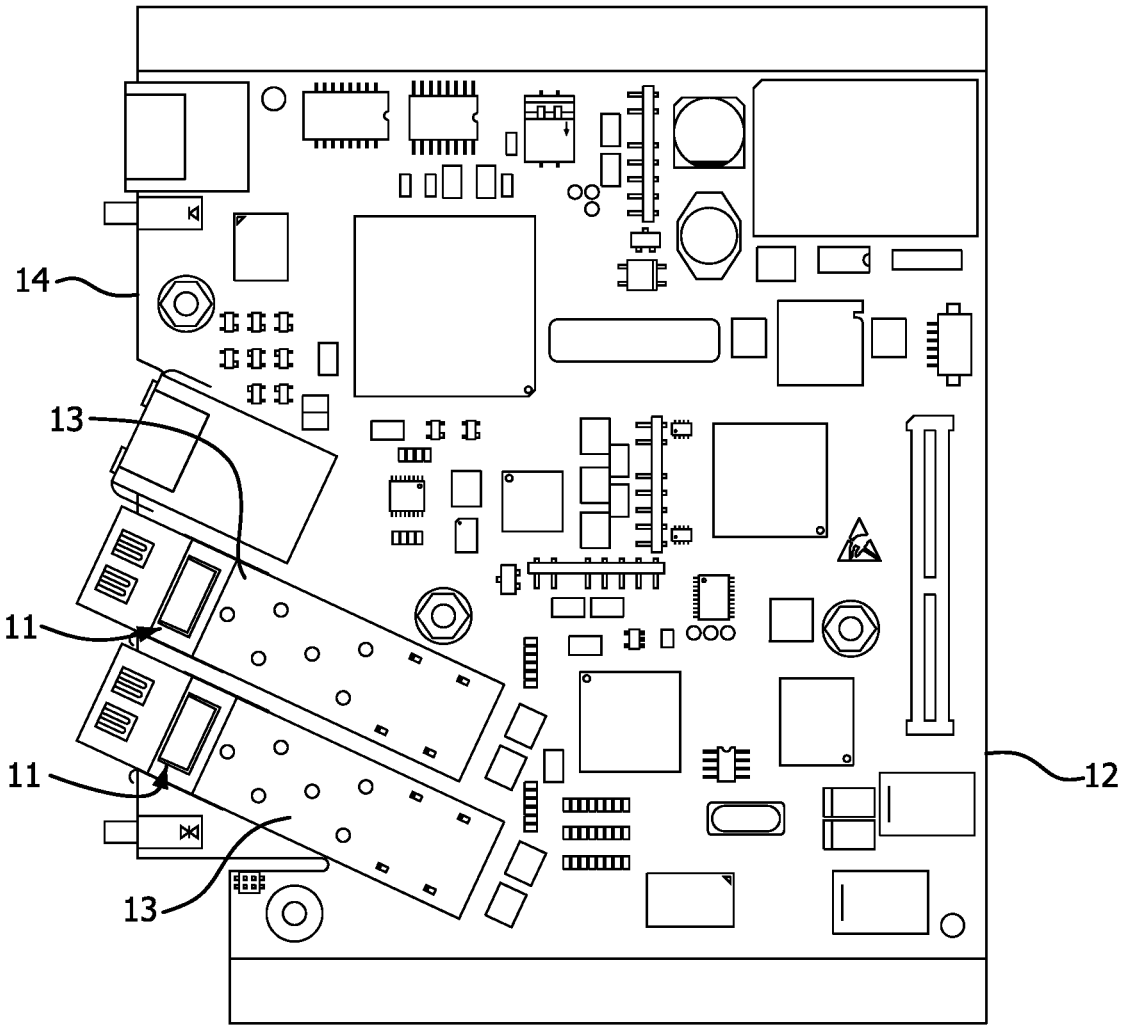
FIG. 1 is a top plan view of a printed circuit to which grounding clips are connected in accordance with an exemplary embodiment of the present invention.
Figure 2:
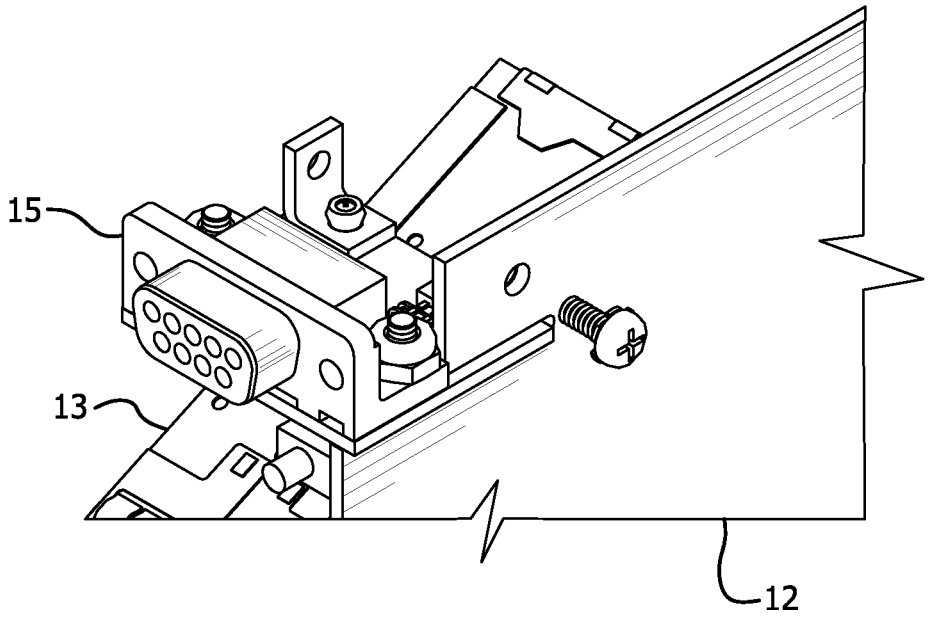
FIG. 2 is a partial perspective view of a network interface unit connected to the printed circuit board of FIG. 1.

As shown in FIGS. 1-3, 14 and 15, a grounding clip 11 in accordance with an exemplary embodiment of the present invention is connected to a printed circuit board 12. The grounding clip 11 is connected (e.g., via compression fit) to a conventional mounting cage 13 for an SFP transceiver module. The mounting cage 13 is connected to the printed circuit board 12 in a conventional manner. Preferably, the mounting cage 13 is connected at an angle to a front face 14 of the printed circuit board 12, as shown in FIG. 1. The angular mounting of the mounting cage 13 prevents infrared light emitted by a plugged in SFP transceiver module from going into a person's eyes when looking at the SFP transceiver module installation. The mounting cage 13 is preferably a dual-high mounting cage such that two SFP transceiver modules can be connected one on top of the other in the mounting cage; however, other types of mounting cages for SFPs can be used. As shown in FIG. 2, two dual-high mounting cages 13 are connected to the printed circuit board 12. An interface unit 15 (e.g., a DB9 connector for a serial interface) is mounted to the printed circuit board 12 adjacent the mounting cage 13.

Figure 4:
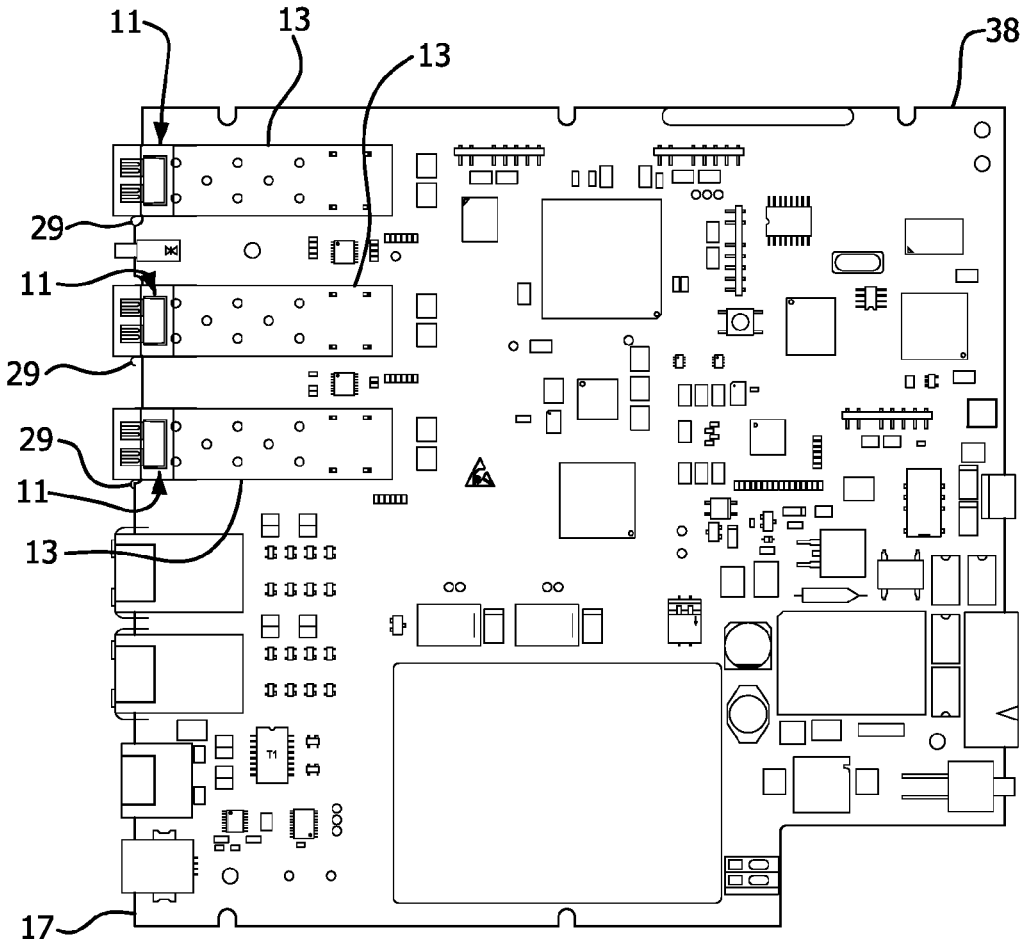
FIG. 4 is a top plan view of grounding clips connected to a chassis in accordance with an exemplary embodiment of the present invention.
Figure 5:
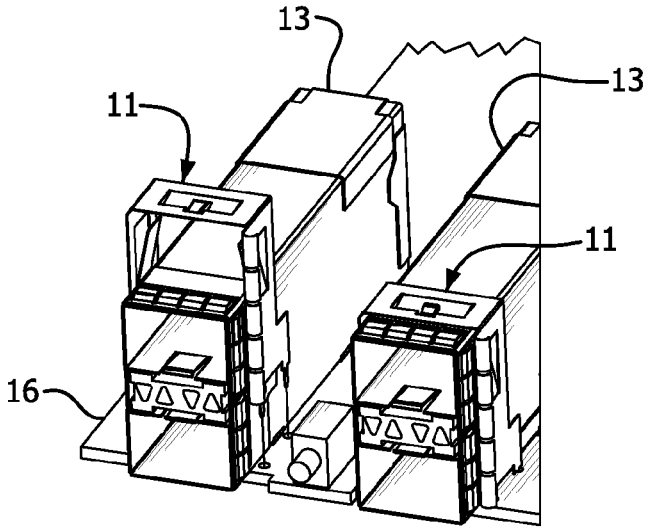
FIG. 5 is a partial perspective view of the grounding clips of FIG. 1 connected to the mounting cage for SFP transceiver modules.
Figure 16:
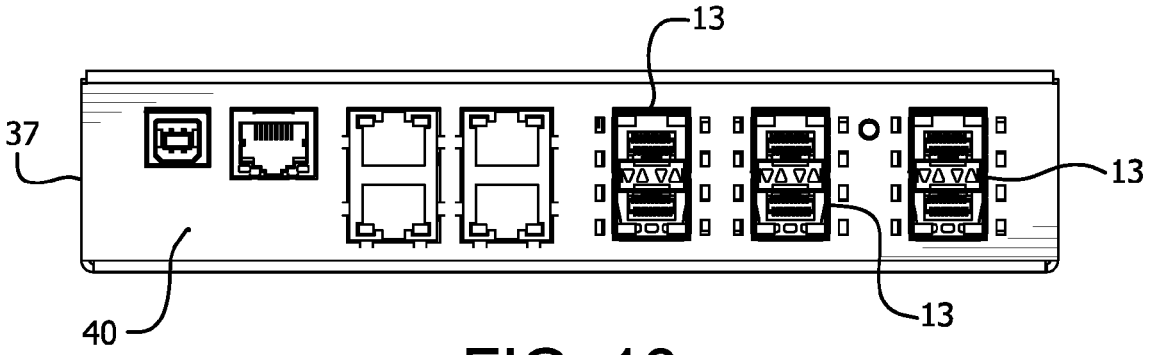
FIG. 16 is front elevational view of a chassis in which the printed circuit board of FIG. 4 is mounted.
Figure 17:
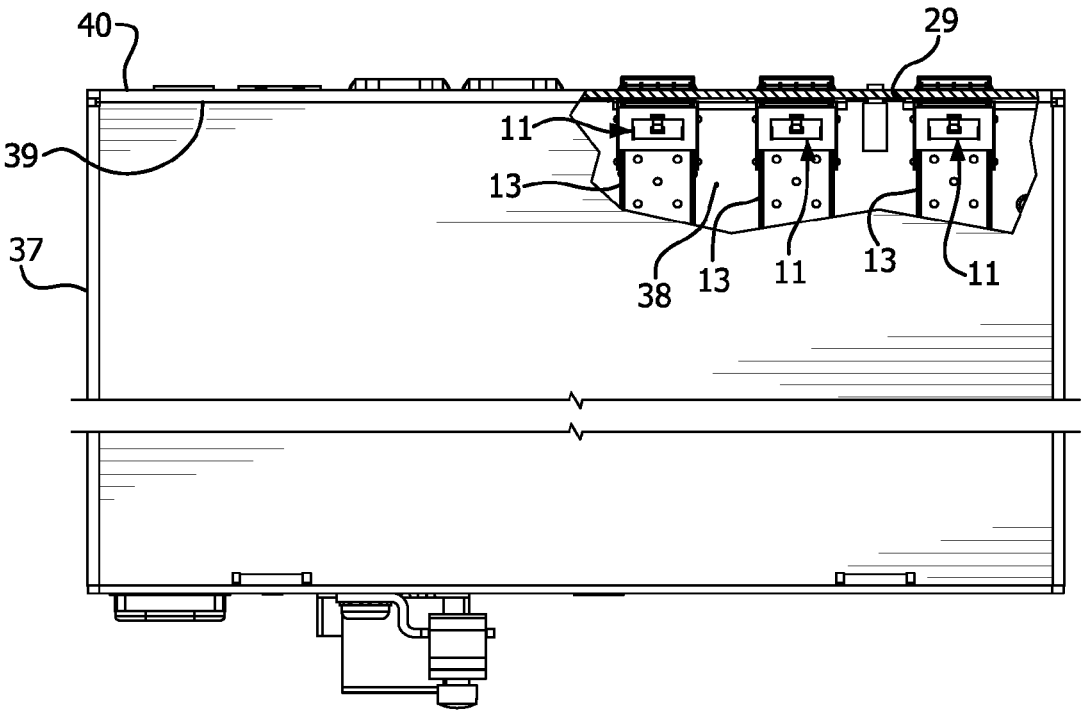
FIG. 17 is a top plan view in partial cutaway of the chassis of FIG. 16.
Figure 18:
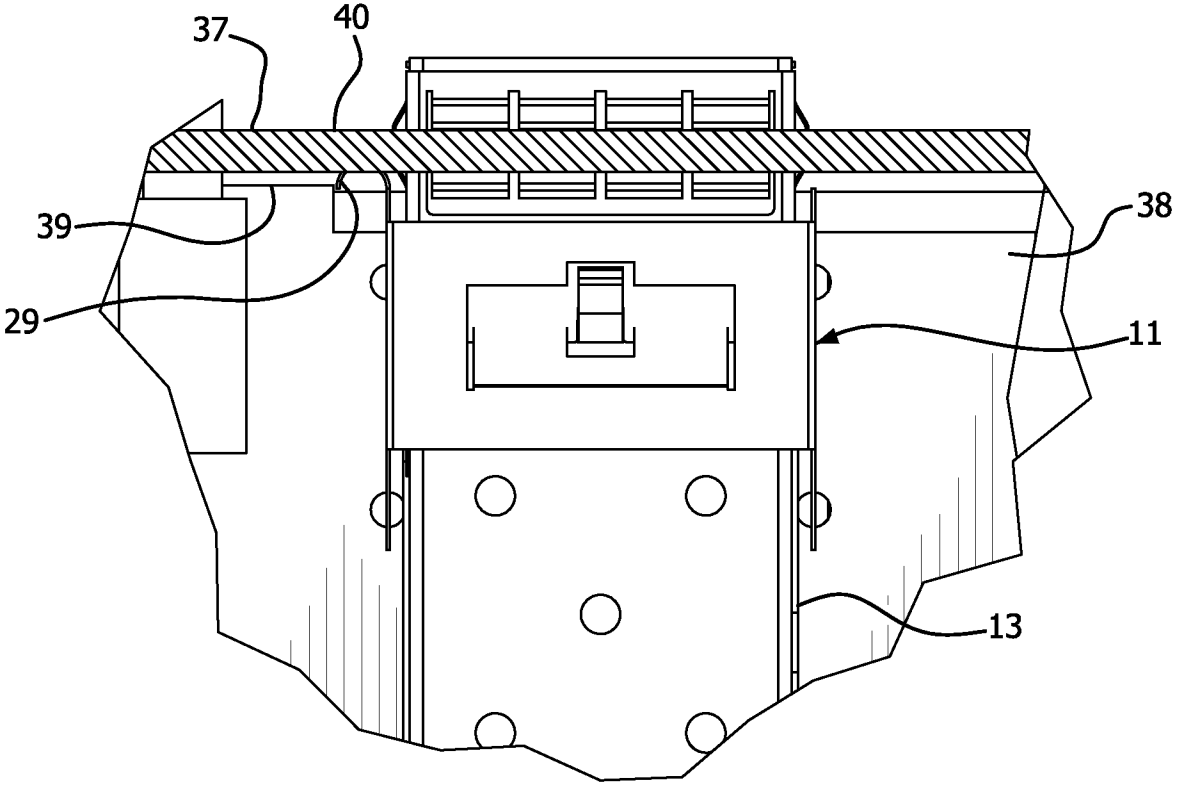
FIG. 18 is an enlarged and partial top plan view of the grounding clip of FIG. 17 connected to an SFP mounting cage and chassis of FIG. 17.

As shown in FIGS. 4, 5 and 16-18, the grounding clip 11 is connected to a printed circuit board 16 and disposed against the mounting cage 13 by a compression fit, for example. The printed circuit board 16 is mounted in a chassis 37, as shown in FIGS. 17 and 18. Preferably, three mounting cages 13 are connected to the PCB 16 in the chassis 37; however, a lesser or greater number of mounting cages can be provided in a PCB, depending on the number of SFPs that are to be accommodated by the PCB. A corresponding number of grounding clips 11 is provided with respect to the number of mounting cages of the SFP, for example. The mounting cage 13 can be a dual-high mounting cage, as shown in FIG. 5, or other type of mounting case (e,g, a mounting cage that only accommodates a single SFP). As shown in FIG. 4, the mounting cages 13 are preferably mounted substantially perpendicular to a front face 17 of the chassis 37.

In accordance with an illustrative embodiment, the grounding clip 11 is shown in FIGS. 6-13. First and second oppositely disposed legs 18 and 19 are connected by a third leg 20. The first and second legs 18 and 19 are substantially parallel. The third leg 20 is substantially perpendicular to the first and second legs 18 and 19. The third leg 20 is preferably connected at ends 21 and 22 of the first and second legs, respectively. Mounting tabs 25 are connected to opposite ends 23 and 24 of the first and second legs 18 and 19, respectively. Preferably, two mounting tabs 25 are connected to each end of the first and second legs 18 and 19. The mounting tabs 25 extend outwardly from the ends 23 and 24 of the first and second legs 18 and 19 and are substantially coplanar therewith, for example.

Figure 10:
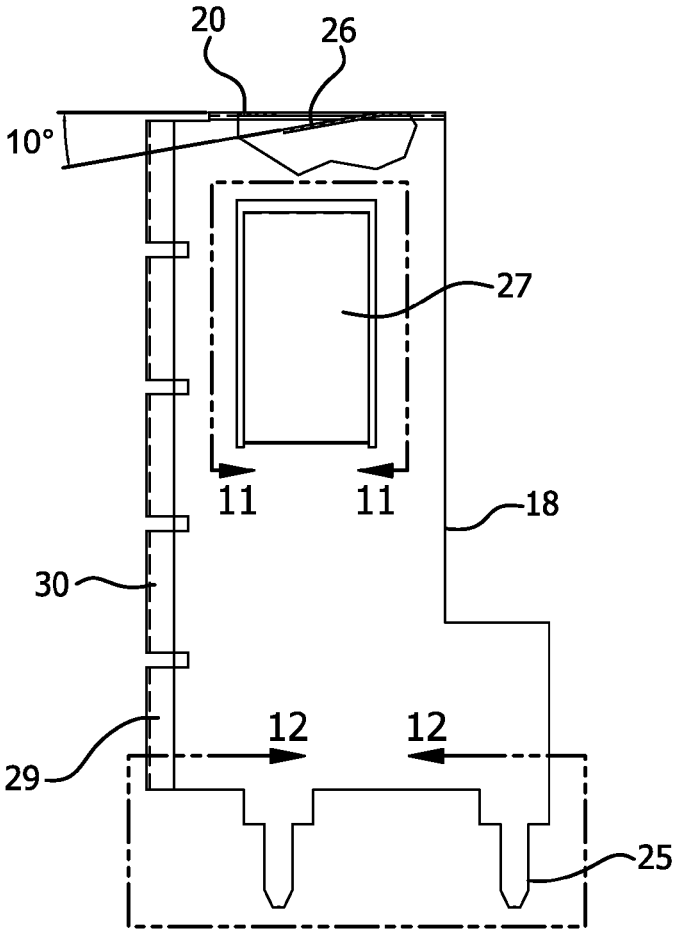
FIG. 10 is a side elevational view of the grounding clip of FIG. 6.
Figure 12:
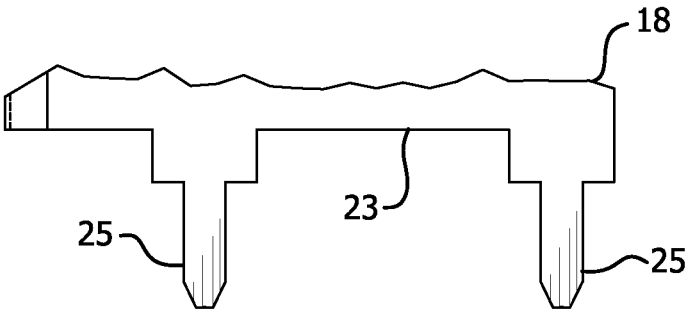
FIG. 12 is an enlarged and partial side elevational view of an electromagnetic gasket of the grounding clip of FIG. 10.

An upper resilient flange 26 is formed in the third leg 20 of the grounding clip 13, as shown in FIGS. 6-9. The flange 26 is biased inwardly toward the mounting tabs 25. As shown in FIG. 10, an angle is formed between the flange 26 and the third leg 20. Preferably, the angle is approximately ten degrees, for example, but can be a different angle.

Figure 6:
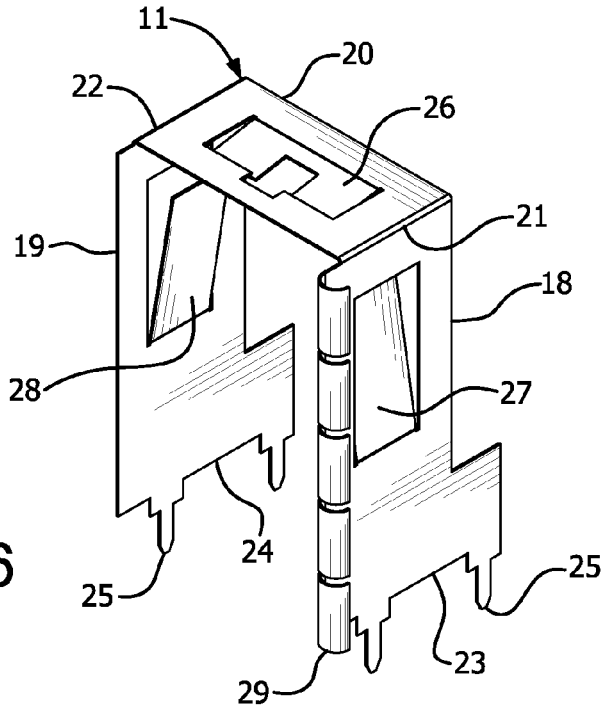
FIG. 6 is a perspective view of the grounding clip of FIG. 1.
Figure 11:
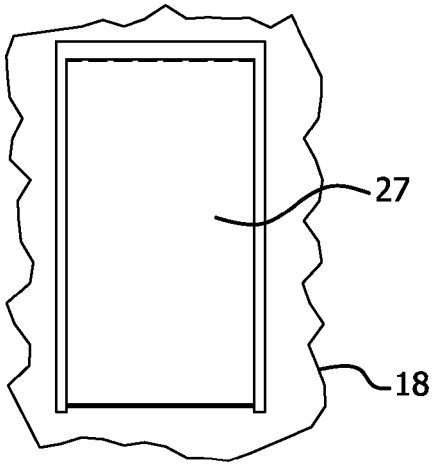
FIG. 11 is an enlarged and partial side elevational view of a side flange of the grounding clip of FIG. 10.
Figure 13:
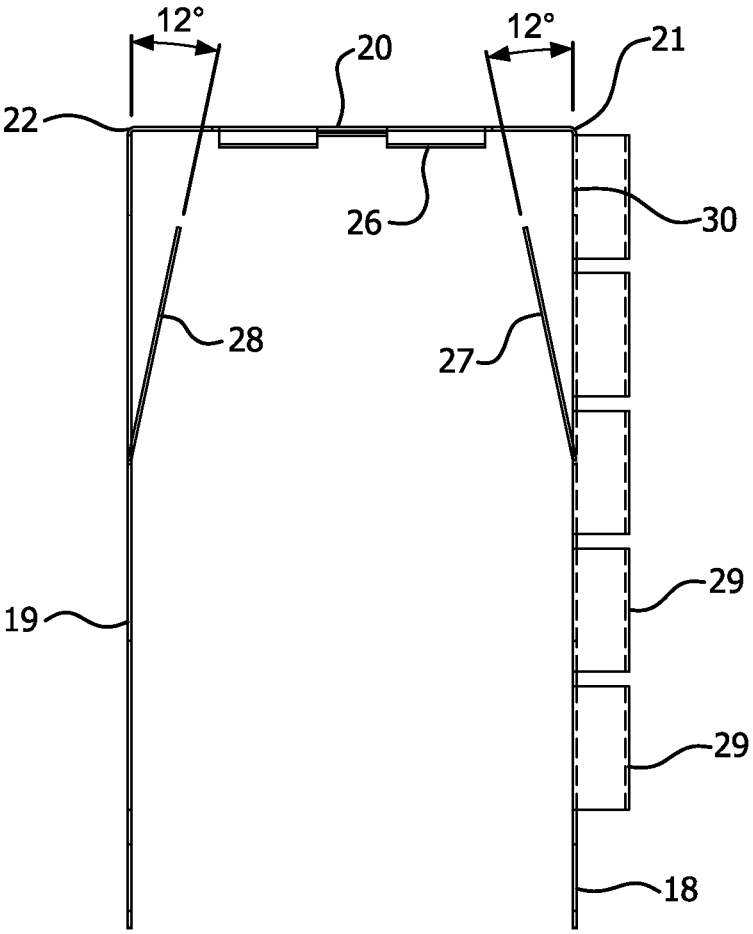
FIG. 13 is a front elevational view of the grounding clip of FIG. 6.

A first side resilient flange 27 is formed in the first leg 18 of the grounding clip 13, as shown in FIGS. 6, 10 and 11. A second side resilient flange 28 is formed in the second leg 19 of the grounding clip 13. The first and second side flanges 27 and 28 extend inwardly toward one another, as shown in FIGS. 6 and 13. The first and second side flanges 27 and 28 form angles with the first and second legs 18 and 19, respectively. The angle is preferably approximately twelve degrees, for example, but can be a different angle.

Figure 3:
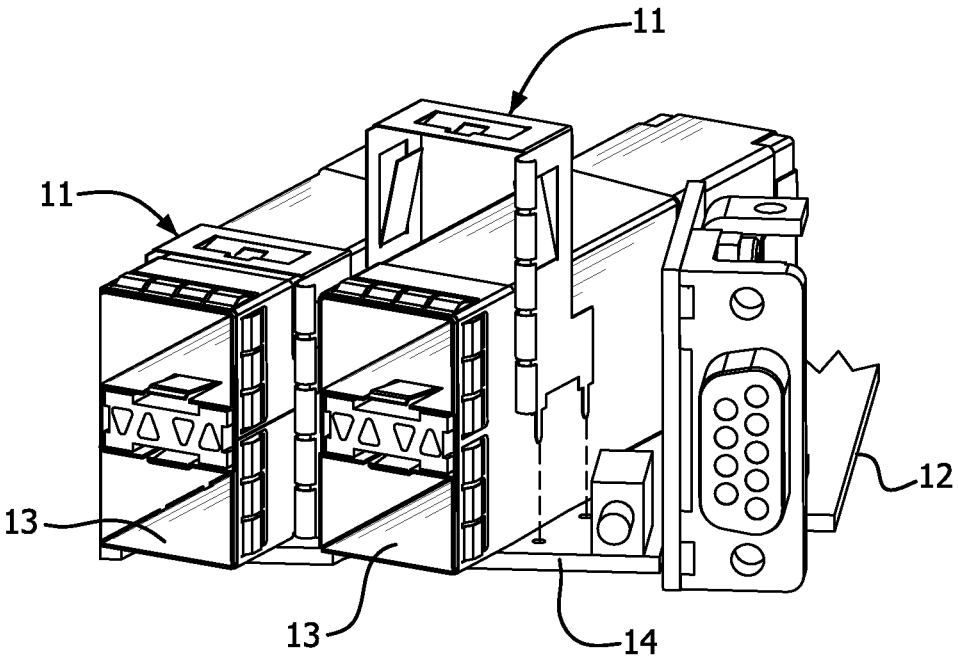
FIG. 3 is a partial perspective view of the grounding clips of FIG. 1 connected to a mounting cage for small form-factor pluggable (SFP) transceiver modules.
Figure 7:
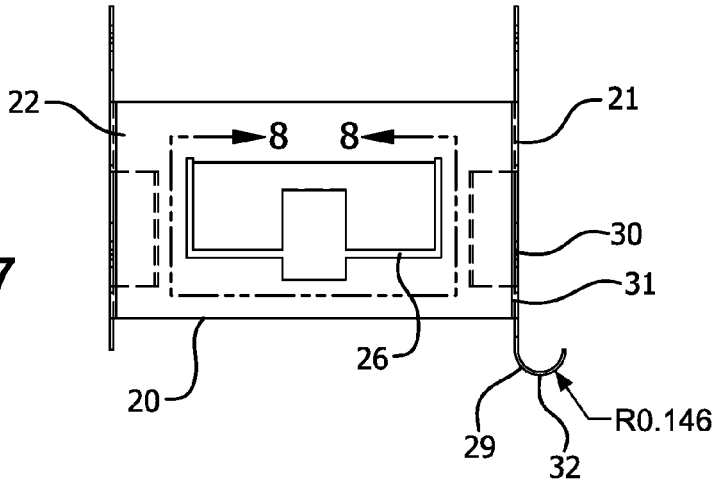
FIG. 7 is a top plan view of the grounding clip of FIG. 6.
Figure 8:
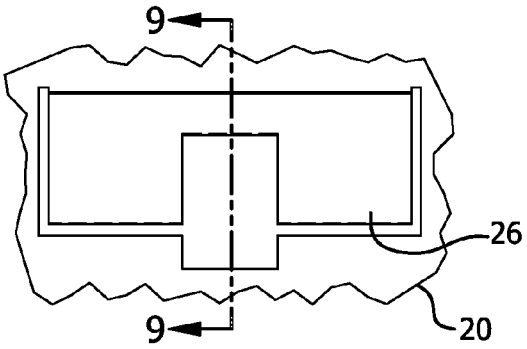
FIG. 8 is an enlarged and partial top plan view of an upper flange of the grounding clip of FIG. 7.
Figure 9:
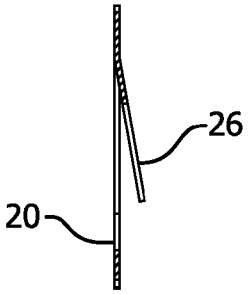
FIG. 9 is a side elevational view in cross-section of the upper flange of the grounding clip of FIG. 8.

A plurality of hook members 29 extend outwardly from an edge 30 of the first leg 18, as shown in FIGS. 6, 7 and 13. Preferably, at least four hook members 29 extend from the edge 30 of the first leg 18. Five hook members 29 are depicted in FIGS. 3 and 6, for example. Plural hook members are disposed generally along the entire edge 30 of the first leg and immediately adjacent to one another, for example. It is to be understood that different spacing of the of hook members 29 along the edge 30 (e.g., along less than the entire length of the edge) and different spacing of the hook members 29 relative to each other can be used. Further, the hook members can be provided on the second leg 19. The hook members 29 can be arranged along the edge 30 of the leg 18 such that the edge of the flange 27 formed in the first leg 18 is disposed toward the center of a hook member 29, as opposed to being disposed relative to a space or gap between two hook members 29 on the edge 30, to allow for optimal material strength to the bend in the material that forms the flange 27 in the leg 18 and to the immediately surrounding area of the leg 18. Each hook member 29 has a first portion 31 extending outwardly from the edge 30 and substantially coplanar with the edge 30. A second portion 32 of each hook member 29 is substantially semi-cylindrical. The plurality of hook members 29 form an electromagnetic gasket for the grounding clip 11.

The grounding clip 11 is preferably unitarily formed as a single piece and is made of a non-sparking material, such as beryllium copper.

As shown in FIGS. 3 and 5, the grounding clip 11 is disposed over the mounting cage 13. The upper flange 26 and the first and second side flanges 27 and 28 extend inwardly to engage resiliently the mounting cage 13, thereby creating a compression fit with the mounting cage. The grounding clip 11 is electrically connected to frame ground by the mounting tabs 25, which pass through and are soldered to a lower side of the printed circuit board 14. Other methods for mounting the tabs 25, however, can be used. The hook members 29 are mechanically compressed against a front panel (e.g., a front panel of the chassis 37 or PCB 16), which contains a contact area that is bare metal. The contact area is masked from the painted portion of the front panel surface. The front panel is mechanically and electrically connected to frame ground via either an attachment to the printed circuit board or via the chassis.

The installed grounding clip 11 substantially prevents electrostatic discharge. When an ESD strike is applied to any part of the front panel, mounting cage, chassis, and so forth, the grounding clip 11 provides a very short return path to frame ground to quickly eliminate the ESD charge and avoid electronic circuit damage. The grounding clip 11 is preferably compliant with the requirement for 8 kV ESD. The grounding clip 11 also reduces EMI emissions in a similar manner.

Figure 15:
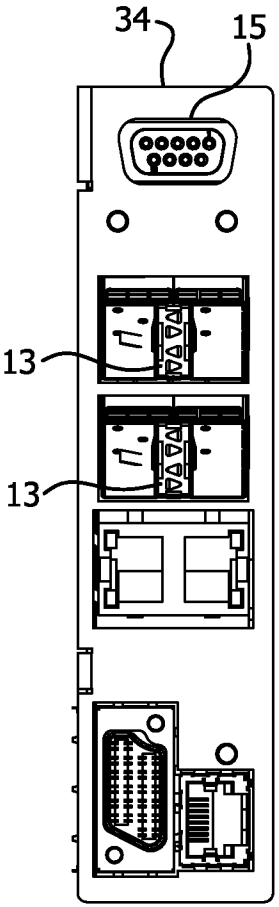
FIG. 15 is a front elevational view of the housing of FIG. 14.
Figure 14:
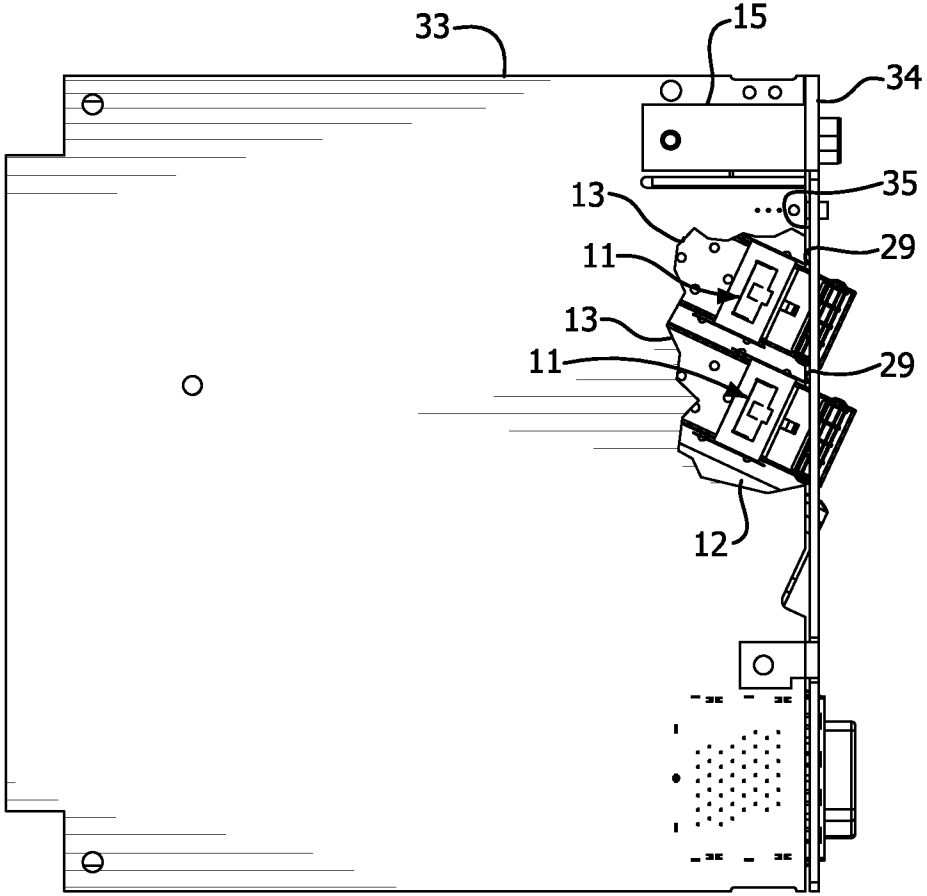
FIG. 14 is a side elevational view in partial cutaway of the grounding clips mounted to the printed circuit board of FIG. 1 mounted in a housing.

The grounding clip 11 is shown connected to a printed circuit board 12 mounted in a housing 33 having a front panel 34, as shown in FIGS. 14 and 15. Small form-factor (SFP) transceivers are connected to the circuit board 12 through the mounting cages 13. The hook members 29 of the grounding clips 11 engage an inner surface 35 of the front panel 34, as shown in FIG. 14. Preferably, the hook members 29 are mechanically compressed by the front panel 34, which includes a contact area that is bare metal and is masked from the remaining painted surface of the front panel 34. The front panel 34 is mechanically and electrically connected to frame ground through the printed circuit board 12.

The grounding clip 11 is shown connected to a chassis 37, as shown in FIGS. 16-18. Small form-factor (SFP) transceivers are connected to a circuit board 38 mounted in the chassis 37 through the mounting cages 13. The hook members 29 of the grounding clips 11 engage an inner surface 39 of a front panel 40 of the chassis 37, as shown in FIGS. 17 and 18. Preferably, the hook members 29 are mechanically compressed by the front panel 40, which includes a contact area that is bare metal and is masked from the remaining painted surface of the front panel 40. The front panel 40 is mechanically and electrically connected to frame ground through the chassis 37.

While advantageous embodiments have been chosen to illustrate the invention, it will be understood by those skilled in the art that various changes and modifications may be made therein without departing from the scope of the invention.

What is claimed is:

1. A grounding clip, comprising:

a first leg oppositely disposed with respect to a second leg and connected to the second leg by a third leg;

at least one first mounting tab connected to an end of the first leg;

at least one second mounting tab connected to an end of the second leg;

a resilient upper flange formed in the third leg and angled with respect to the third leg inwardly toward the at least one first mounting tab and the at least one second mounting tab;

a resilient first side flange formed in the first leg and angled with respect to the first leg;

a resilient second side flange formed in the second leg and angled with respect to the second leg, wherein the first side flange and the second side flange extend inwardly toward one another; and at least one hook member extending outwardly from an edge of the first leg.

2. The grounding clip of claim 1, wherein the first leg is substantially parallel to the second leg.

3. The grounding clip of claim 1, wherein the at least one first mounting tab is substantially coplanar with the first leg.

4. The grounding clip of claim 1, wherein an angle formed between the upper flange and the third leg is about ten degrees.

5. The grounding clip of claim 1, wherein an angle formed between the first side flange and the first leg is about twelve degrees.

6. The grounding clip of claim 1, wherein the at least one hook member comprises at least four hook members.

7. The grounding clip of claim 1, wherein the at least one hook member comprises:

a first portion extending outwardly from the edge and substantially coplanar with the edge; and a second portion extending from the first portion that is substantially semi-cylindrical.

8. The grounding clip of claim 1, wherein the at least one hook member forms an electromagnetic gasket for the grounding clip.

9. The grounding clip of claim 1, wherein the grounding clip is unitarily formed.

10. The grounding clip of claim 1, wherein the grounding clip comprises a non-sparking material.

11. The grounding clip of claim 1, wherein the grounding clip comprises beryllium copper.

12. A printed circuit in combination with a grounding clip, the grounding clip comprising:

a first leg oppositely disposed with respect to a second leg and connected to the second leg by a third leg;

at least one first mounting tab connected to an end of the first leg;

at least one second mounting tab connected to an end of the second leg;

a resilient upper flange formed in the third leg and angled with respect to the third leg inwardly toward the at least one first mounting tab and the at least one second mounting tab;

a resilient first side flange formed in the first leg and angled with respect to the first leg;

a resilient second side flange formed in the second leg and angled with respect to the second leg, wherein the first side flange and the second side flange extend inwardly toward one another; and at least one hook member extending outwardly from an edge of the first leg, the printed circuit comprising a mounting cage, wherein the grounding clip is disposed over the mounting cage.

13. The printed circuit in combination with the grounding clip of claim 12, wherein a small form-factor transceiver is connected to the printed circuit through the mounting cage.

14. The printed circuit in combination with the grounding clip of claim 12, wherein the upper flange, the first side flange and the second side flange extend inwardly to resiliently engage the mounting cage.

15. The printed circuit in combination with the grounding clip of claim 12, wherein the upper flange, the first side flange and the second side flange create a compression fit with the mounting cage.

16. The printed circuit in combination with the grounding clip of claim 12, wherein the grounding clip is electrically connected to a frame ground by at least one selected from the set consisting of the at least one first mounting tab and the at least one second mounting tab.

17. The printed circuit in combination with the grounding clip of claim 12, wherein the at least one first mounting tab and the at least one second mounting tab pass through and are soldered to a lower side of a printed circuit board.

18. The printed circuit in combination with the grounding clip of claim 12, wherein the at least one hook member is mechanically compressed against a front panel that is mechanically and electrically connected to a frame ground.

19. A method of avoiding electronic circuit damage to an electrical component, comprising:

providing a printed circuit comprising a mounting cage adapted to receive the electrical component;

providing a grounding clip comprising:

a first leg oppositely disposed with respect to a second leg and connected to the second leg by a third leg;

at least one first mounting tab connected to an end of the first leg;

at least one second mounting tab connected to an end of the second leg;

a resilient upper flange formed in the third leg and angled with respect to the third leg inwardly toward the at least one first mounting tab and the at least one second mounting tab;

a resilient first side flange formed in the first leg and angled with respect to the first leg;

a resilient second side flange formed in the second leg and angled with respect to the second leg, wherein the first side flange and the second side flange extend inwardly toward one another; and at least one hook member extending outwardly from an edge of the first leg; and disposing the grounding clip over the mounting cage.

20. The method of avoiding electronic circuit damage to an electrical component of claim 19, further comprising receiving a first electrical component in the mounting cage.

* * * * *